US010260211B2

(12) United States Patent
Peterson

(10) Patent No.: US 10,260,211 B2
(45) Date of Patent: Apr. 16, 2019

(54) RAPIDLY DEPLOYABLE PREFABRICATED FOLDING BUILDING SYSTEM

(71) Applicant: FOLDING HOLDINGS LLC, Woodinville, WA (US)

(72) Inventor: Elliot Peterson, Woodinville, WA (US)

( * ) Notice: Subject to any disclaimer, the term of this patent is extended or adjusted under 35 U.S.C. 154(b) by 0 days.

(21) Appl. No.: 15/820,341

(22) Filed: Nov. 21, 2017

(65) Prior Publication Data

US 2018/0340310 A1 Nov. 29, 2018

Related U.S. Application Data

(63) Continuation-in-part of application No. 15/605,918, filed on May 25, 2017.

(51) Int. Cl.

| | |
|---|---|
| ***E02D 27/02*** | (2006.01) |
| ***E04B 1/348*** | (2006.01) |
| ***E04B 1/19*** | (2006.01) |
| ***E04B 1/24*** | (2006.01) |
| ***E04B 1/344*** | (2006.01) |
| ***E02D 27/50*** | (2006.01) |
| ***E04B 1/343*** | (2006.01) |
| ***E04H 1/12*** | (2006.01) |

(52) U.S. Cl.

CPC ..... *E02D 27/02* (2013.01); *E02D 27/50* (2013.01); *E04B 1/19* (2013.01); *E04B 1/24* (2013.01); *E04B 1/3445* (2013.01); *E04B 1/3483* (2013.01); *E04B 1/34321* (2013.01); *E04H 1/1205* (2013.01); *E02D 2220/00* (2013.01); *E02D 2300/0029* (2013.01); *E02D 2600/20* (2013.01); *E02D 2600/30* (2013.01); *E04B 2001/34389* (2013.01); *E04B 2103/06* (2013.01)

(58) Field of Classification Search

CPC ..... E02D 27/02; E02D 27/50; E02D 2600/30; E02D 5/801; E04B 1/19; E04B 1/24; E04B 1/3445; E04B 1/3483; E04H 9/14; E04H 12/2223; Y10S 52/11

USPC ..... 52/23, 157, 293.3, 299, DIG. 11

See application file for complete search history.

(56) References Cited

U.S. PATENT DOCUMENTS 826,996 A * 7/1906 Cooke ..... E02D 27/02 52/292

3,623,288 A * 11/1971 Horowitz ..... E04B 1/10 52/264

(Continued)

*Primary Examiner* — Brian E Glessner

*Assistant Examiner* — Adam G Barlow

(74) *Attorney, Agent, or Firm* — Keith L. Jenkins, Registered Patent Attorney LLC; Keith L. Jenkins

(57) ABSTRACT

A fully recoverable modular steel footing and beam system that allows installation of the rapidly deployable prefabricated folding building system on a wide variety of substrates, including bare earth, existing asphalt, and existing concrete. The substrate may show deviation from level and still be accommodated. The invention also includes three-part folding haunch and ridge braces allowing braces to ship attached to building panels resulting in minimal handling, reduced weights, and ability to install roof and walls separately. Roof weight is reduced and so can be handled with a forklift or telehandler, as the only heavy equipment needed to erect the building. Flashings are insulated, factory cut, and drilled for bolts, in alignable pattern to bolt-receiving rivets installed in the corrugated siding and roofing. Bolts and bolt installation locations are color coded.

20 Claims, 10 Drawing Sheets

(56) References Cited

U.S. PATENT DOCUMENTS 3,845,597 A * 11/1974 Foster ..... E02D 5/80 52/157
4,863,137 A * 9/1989 Cockman ..... E02D 5/801 248/545
4,923,165 A * 5/1990 Cockman ..... E02D 5/801 248/156
5,675,194 A 10/1997 Domigan
5,873,679 A * 2/1999 Cusimano ..... E02D 27/48 405/229
6,058,663 A * 5/2000 MacKarvich ..... E02D 27/02 52/167.3
6,119,412 A * 9/2000 Jackson ..... E04B 1/34352 248/188.1
6,176,056 B1 * 1/2001 MacKarvich ..... E02D 5/801 248/499
6,247,276 B1 * 6/2001 Masters ..... E04B 1/34347 52/169.12
6,318,032 B2 * 11/2001 MacKarvich ..... E02D 27/02 52/167.3
6,418,684 B1 * 7/2002 Morton ..... E04G 23/0218 52/293.2
6,418,685 B1 * 7/2002 Oliver ..... E02D 5/801 24/199
6,438,903 B1 8/2002 Weiss
6,585,454 B1 * 7/2003 Fisher ..... E02B 3/068 405/203
6,591,564 B2 * 7/2003 Cusimano ..... E02D 27/01 248/156
7,419,335 B1 * 9/2008 Cohen ..... E04G 23/0218 248/351
7,610,733 B2 * 11/2009 Rizzotto ..... E02D 27/42 52/155
8,955,283 B2 * 2/2015 Takagi ..... E04D 13/1407 52/649.2
2002/0083660 A1 * 7/2002 Oliver ..... E02D 5/801 52/169.9
2003/0140578 A1 * 7/2003 Moreno, Jr. ..... E02D 27/01 52/169.1
2004/0071511 A1 * 4/2004 May ..... E02D 35/00 405/231
2012/0066992 A1 * 3/2012 Moreno ..... E04B 1/34352 52/299
2012/0304555 A1 * 12/2012 Oliver ..... E02D 27/01 52/157
2014/0020310 A1 * 1/2014 Lee ..... E02D 7/22 52/157
2016/0186403 A1 * 6/2016 Tomchesson ..... E02D 5/526 405/244

* cited by examiner

RAPIDLY DEPLOYABLE PREFABRICATED FOLDING BUILDING SYSTEM

RELATIONSHIP TO OTHER APPLICATIONS

This application is a continuation in part of U.S. patent application Ser. No. 15/605,918 filed May 25, 2017 to the same inventor.

FIELD OF ART

The present invention relates to prefabricated buildings made principally of steel. The present invention more particularly relates to a rapidly deployable prefabricated folding building that does not require a full-size concrete foundation pad for support.

BACKGROUND OF THE INVENTION

A number of prefabricated folding steel buildings have been invented by the present inventor, such as U.S. Pat. No. 9,222,250, which is incorporated herein by reference. Such buildings use sections each having two wall and two connecting roof panels, set side by side, and connected to form a building. There is a need for such buildings that do not require time-consuming surface preparation such as exact leveling and concrete pad production, and so can be more rapidly deployed for civil and military applications. There is yet a further need for a rapidly deployable building that may use only one piece of heavy equipment for erection. There is yet an even further need for a rapidly deployable building that is made of completely reusable components

SUMMARY OF THE INVENTION

Briefly described, the invention includes a fully recoverable and reusable modular steel footing and beam system that allows installation of the rapidly deployable prefabricated folding building system on a wide variety of substrates, including bare earth, existing asphalt, and existing concrete. The substrate may show some deviation from level and still be accommodated. The invention also includes three-part folding haunch and ridge braces allowing braces to ship attached to building panels resulting in minimal handling, reduced weights, and ability to install roof and walls separately. Roof weight is reduced and so can be handled with a forklift or telehandler, as the only heavy equipment needed to erect the building. Flashings are insulated, factory cut, and drilled for fasteners, in alignable pattern to fastener-receiving rivets installed in the corrugated siding and roofing. Fasteners and fastener installation locations are color coded.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

As used and defined herein, "upward," "downward," "top," and "bottom," as well as other words of relative positioning, refer to the building or part thereof in its operational orientation.

Figure 1:
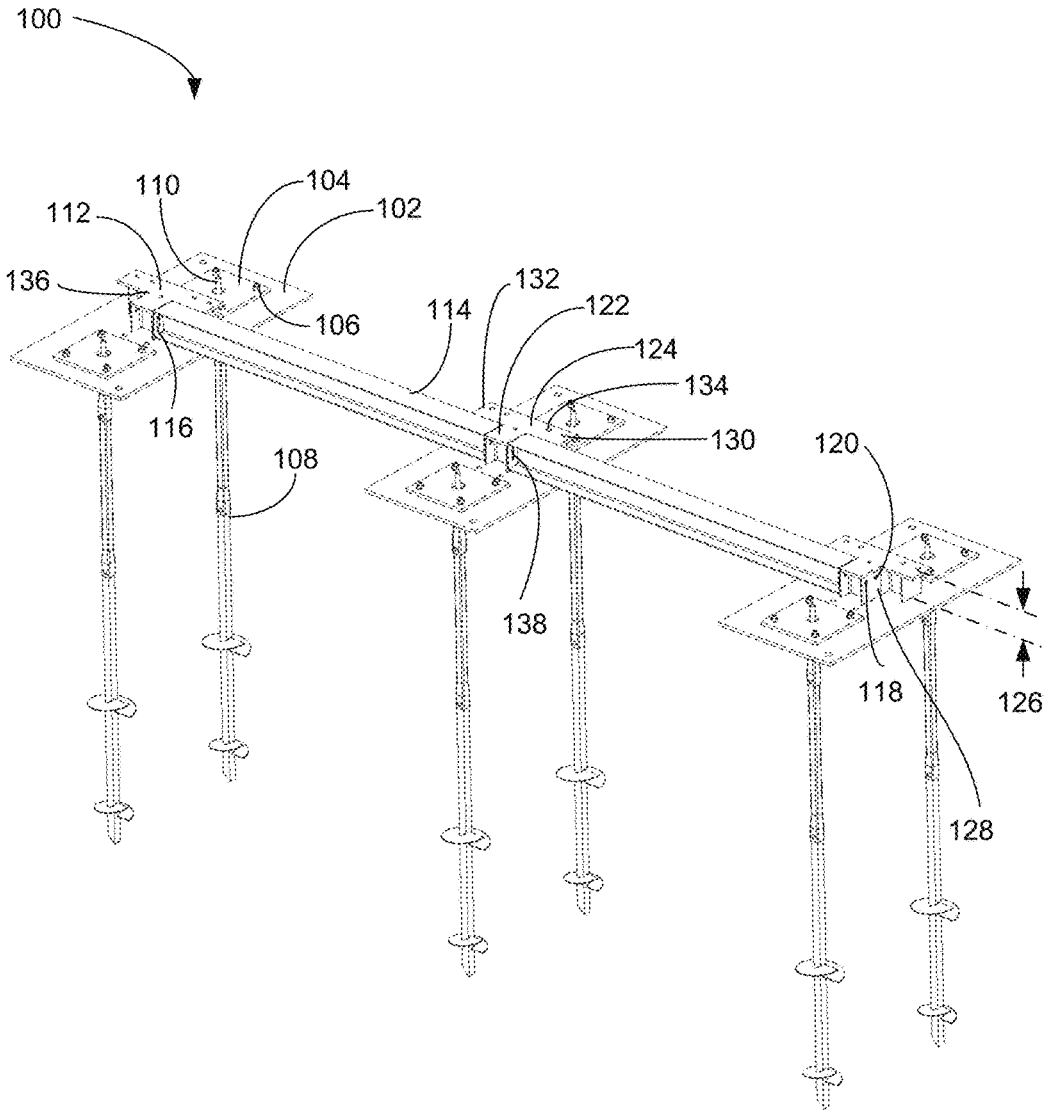
FIG. 1 is a top perspective view illustrating an exemplary footing structure of an embodiment of the rapidly deployable prefabricated folding building, according to a preferred embodiment of the present invention.

FIG. 1 is a top perspective view illustrating an exemplary footing structure 100 of an embodiment of the rapidly deployable prefabricated folding building 200 (see FIG. 2), according to a preferred embodiment of the present invention. In operation, bearing plate 102 (one of three labeled) rests on the ground or other supporting surface such as, without limitation, asphalt, concrete, natural stone, ice, or hard pan desert. Depending on the characteristics of the supporting substrate, bearing plates 102 may vary in size and anchors 108 may vary in type and depth. Anchor adapter plates 104 (one of six labeled) are fastened to bearing plates 102 with fasteners 106 (one of twenty-four labeled) which are preferably bolts with lock washers. Anchor adapter plates 104 secure the ground anchors 108 (one of six labeled) to the bearing plates 102. A drive shaft 110 of the ground anchor 108 extends above the anchor adapter plate 104 so that, with the anchor adapter plate removed, drive shaft 110 can be coupled to a motorized drive to remove the anchor 108. Responsive to various substrates, various types of anchors 108 may be used. For non-limiting example, on a concrete substrate, concrete anchors, as are known in the art, may be used. Those of skill in the art, enlightened by this disclosure, will be able to select appropriate anchors for various substrates.

Building attachment plate 112 is fixed to bearing plate 102 via vertical steel plates 128 (one of many labeled) and is T-shaped with the corners 136 (one of six labeled) of the "T" used to receive connecting beams 114 (one of two labeled) at adjustable heights. The stem 122 of the "T" is used to support two adjacent columns 302 and 1102 (see FIGS. 3 and 11) of adjacent wall panels 308 and 1114 (see FIG. 11). The crossbar 124 of the "T" has opposing ends 130 and 132 and each has two bolt holes 134 (one of twelve labeled) corresponding to bolt holes 314 and 316 (one each of six labeled) in each rafter footing 312 (see FIG. 3). It is the bolting of the rafter footing 312 to the building attachment plate 112 that secures the wall panel 308 (see FIG. 3) to the steel bearing plate 102.

Connecting beams 114 are preferably steel I-beams with closed, slotted 138 ends 116. There are four slotted 138 ends 116 on each connecting beam, two at each end, separated by the web of the I-beam. The illustrated height 126 of the building attachment plate 112 is approximately the minimum, as tools must be used under the building attachment plate 112 to secure the aforementioned bolts. The greater the height 126, the greater the deviation from level the substrate may be. Bolt holes 118 and 120 are proximate the top of a plate 128 and correspond to the top of the slots 138 in ends 116 of the connecting beams 114. Plate 128 is the side of the stem 122 of the building attachment plate 112. Thus, the end of the connecting beam 114 can be adjusted upward by the height of the slot 138 to maintain a constant level of the connecting beams 114 against varying terrain. Increasing height 126 would enable additional bolt holes 118 and 120 at higher level on plate 128, thereby enabling adaptation to even more uneven terrain in various embodiments.

In various embodiments, various numbers of bearing plates 102 and connecting beams 114 may be configured and arranged in parallel linear spaced-apart arrays, with no arbitrary upper limit on the number, to make a building of any desired length. In a particular embodiment, a rapidly deployable prefabricated folding building 200 may be supported on more than one substrate. For example, a portion of the rapidly deployable prefabricated folding building 200 may be supported on concrete and then extend onto bare earth. The advantages of this steel bearing plate 102 and connecting beam 114 system include: providing a level arrangement of connecting beams 114 on non-level ground; providing various anchoring options for various substrates; requiring no significant excavation; requiring no concrete, being fully recoverable and reusable; and being adaptable to multiple substrates under one rapidly deployable prefabricated folding building 200.

Figure 2:
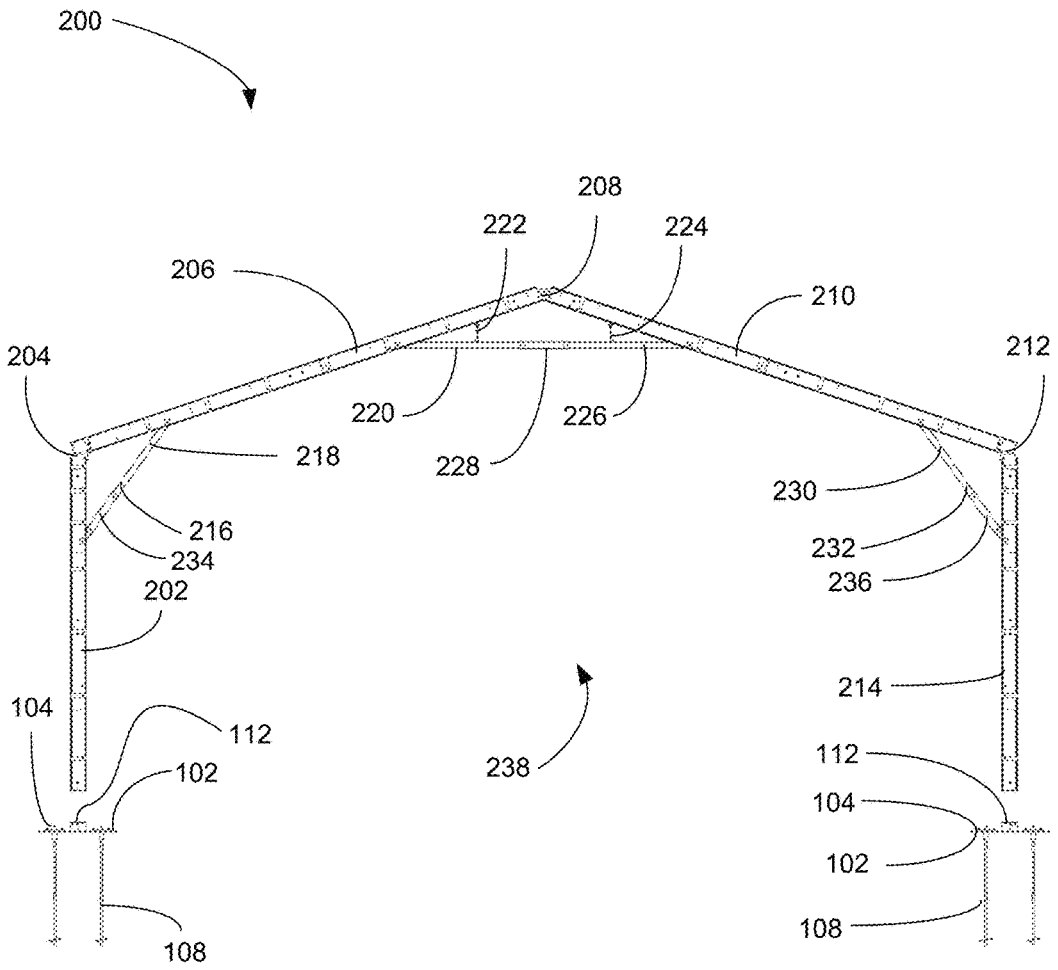
FIG. 2 is a front exploded elevation view illustrating an exemplary embodiment of the rapidly deployable prefabricated folding building, according to a preferred embodiment of the present invention.

FIG. 2 is a front exploded elevation view illustrating a first exemplary embodiment of the rapidly deployable prefabricated folding building 200, according to a preferred embodiment of the present invention. Rapidly deployable prefabricated folding building 200 is shown in an exemplary late step of construction with the bearing plates 102 installed and the rafters 206 and 210 and walls connected as a four-panel section 238 and suspended in air using a large forklift (not shown) or the like. Three-part haunch braces 216, 218 and 234; and 230, 232, and 236 are not connected, allowing columns 202 and 214 to rotate freely from the ends 204 and 212, respectively, of rafters 206 and 210, respectively. In the illustrated configuration, it is easy to align the bottom ends of columns 202 and 214 with their respective building attachment plates 112. After the columns are attached, via pre-drilled aligned fastener holes, the three-part haunch braces 216, 218 and 234; and 230, 232, and 236 are connected and bolted.

Three-part ridge brace 220, 228, and 226 is shown in its assembled configuration. Ridge brace arms 220 and 226 are held in horizontal position by supports 222 and 224, respectively, during and after assembly. Five-hole ridge plate 208 pivotally connects rafters 206 and 210 in folded configuration during storage and shipping and rigidly connects rafters 206 and 210 at the deployed angle after assembly. Supports 222 and 224 are preferably stowable filaments, such as, without limitation, cable or chain.

Figure 3:
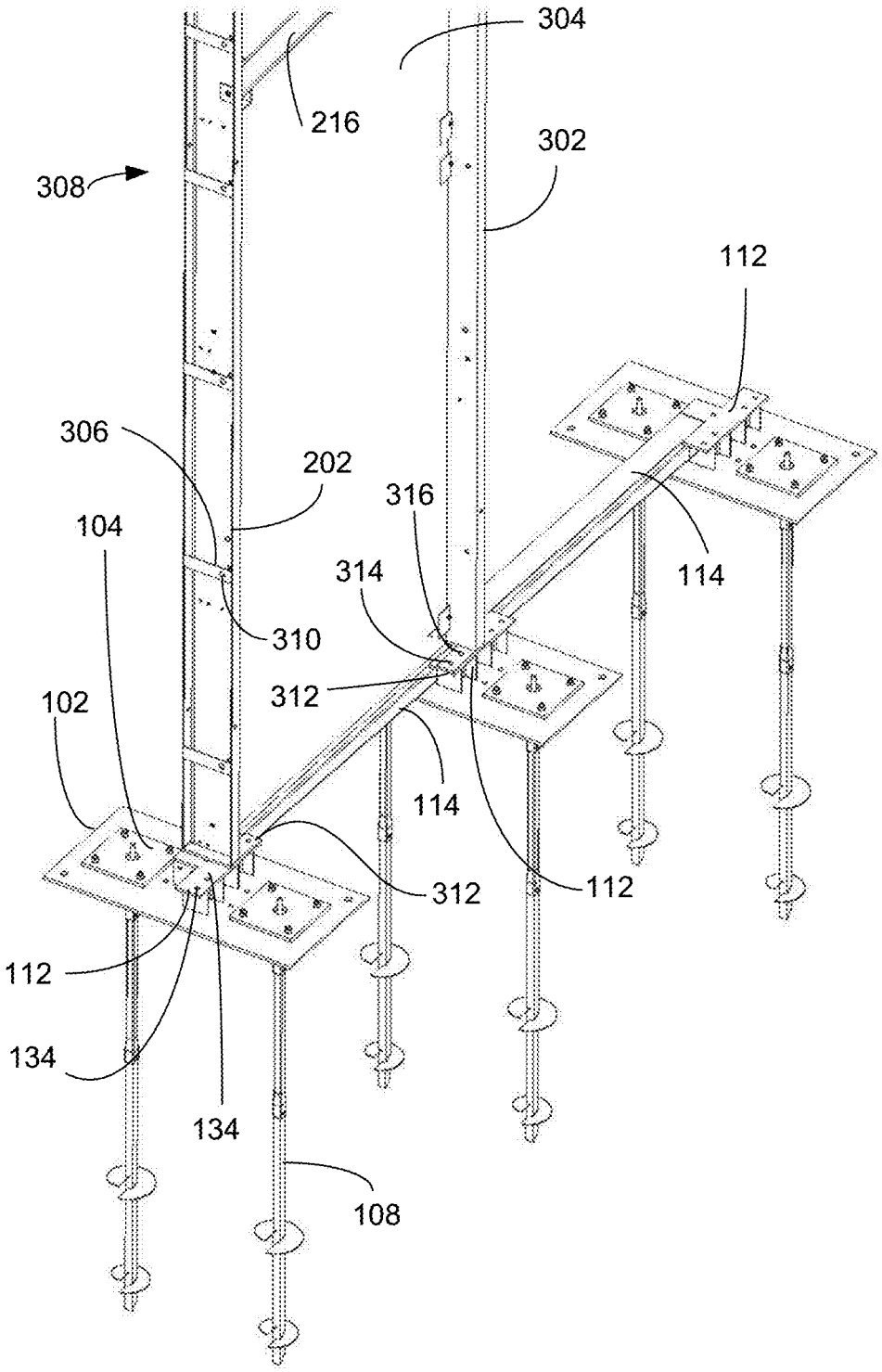
FIG. 3 is a perspective view illustrating an exemplary embodiment of a detail of the rapidly deployable prefabricated folding building of FIG. 2, according to a preferred embodiment of the present invention.

FIG. 3 is a perspective view illustrating an exemplary embodiment of a detail of the rapidly deployable prefabricated folding building 200 of FIG. 2, according to a preferred embodiment of the present invention. A wall panel 308 of a four-panel section 238 is shown supported by connecting beam 114 and connected to building attachment plates 112 via bolts through footing plates 312 having bolt holes 314 and 316 corresponding to bolt holes 134 in the building attachment plate 112. Wall panel 308 includes columns 202 and 302 with a sheet 304 of material extending there between. Sheet 304 may be a composite material that includes insulation, penetration resistant materials, and structurally supportive materials. Columns 202 and 302 are C-channel steel with supportive cross strips 306 (one of five labeled) at points for bolting wall panels together side-by-side. Bolt holes 310 (one of five labeled) align to similar holes in the web of the C-channel. Note that each column 202 and 302 take up only half of the width of the stem of each T-shaped building attachment plate 112.

Figure 4A:
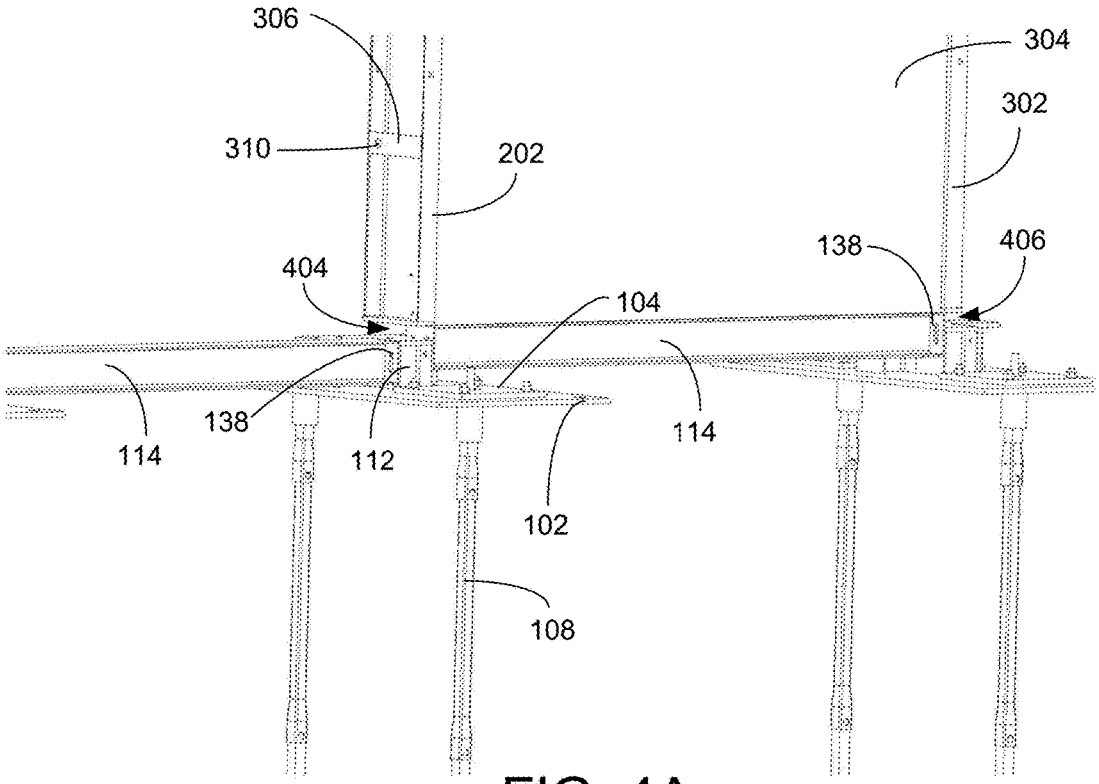
FIG. 4A is a perspective view illustrating an exemplary embodiment of a detail of the rapidly deployable prefabricated folding building of FIG. 2, according to a preferred embodiment of the present invention.

FIG. 4A is a perspective view illustrating an exemplary embodiment of a detail of the rapidly deployable prefabricated folding building 200 of FIG. 2, according to a preferred embodiment of the present invention. The slots 138 in the ends of connecting beams 114 can receive bolts into vertical plates 128 of building attachment plates 112 to raise the connecting beams relative to building attachment plate 112 by different amounts at each end, thereby keeping the connecting beam 114 level on un-level substrate. Preferably, shims 408 (see FIGS. 4B and 4C), shaped like the footing plate of the column 202, are used at cavities 404 and 406. In a particular embodiment, the height of building attachment plates 112 can be increased to accommodate a higher slope of the substrate.

Figure 4B:
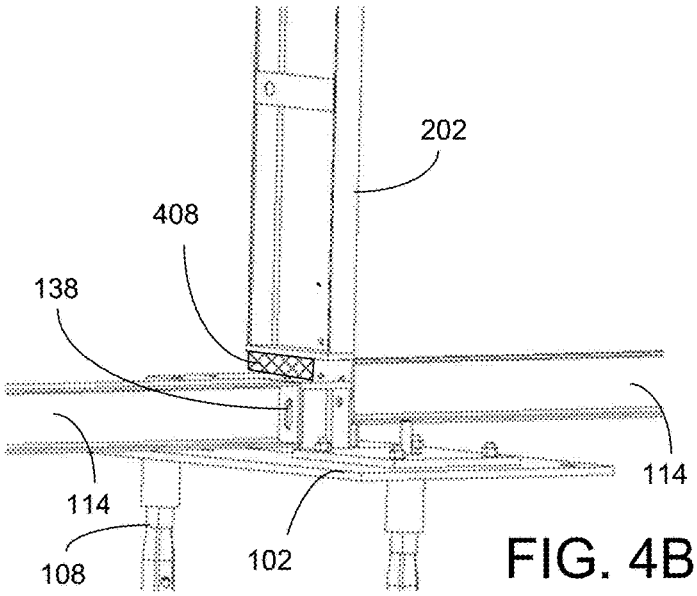
FIG. 4B is a perspective view illustrating an exemplary embodiment of a detail of the rapidly deployable prefabricated folding building of FIG. 2, according to a preferred embodiment of the present invention.

FIG. 4B is a perspective view illustrating an exemplary embodiment of a detail of the rapidly deployable prefabricated folding building 200 of FIG. 2, according to a preferred embodiment of the present invention. Shims 408 are shaped like the footing plate 312 of the rafter 302 and has bolt holes 410 and 412 to accommodate connection of the footing plate 312 through the shims 408 to the building attachment plate 112. Preferably, shims 408 are a stack of thin plates that can be stacked according to the needed height in each case. A wedge may be used to finish the shim 408.

Figure 4C:
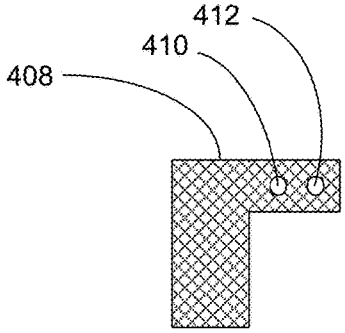
FIG. 4C is a top plan view illustrating an exemplary embodiment of a shim of the rapidly deployable prefabricated folding building of FIG. 2, according to a preferred embodiment of the present invention.

FIG. 4C is a top plan view illustrating an exemplary embodiment of a shim 408 of the rapidly deployable prefabricated folding building 200 of FIG. 2, according to a preferred embodiment of the present invention. Shim 408 has the shape of a footing plate of column 202 with bolt holes 410 and 412 to accommodate connection of the footing plate 312 through the shims 408 to the building attachment plate 112 and, thereby, to bearing plate 102.

Figure 5:
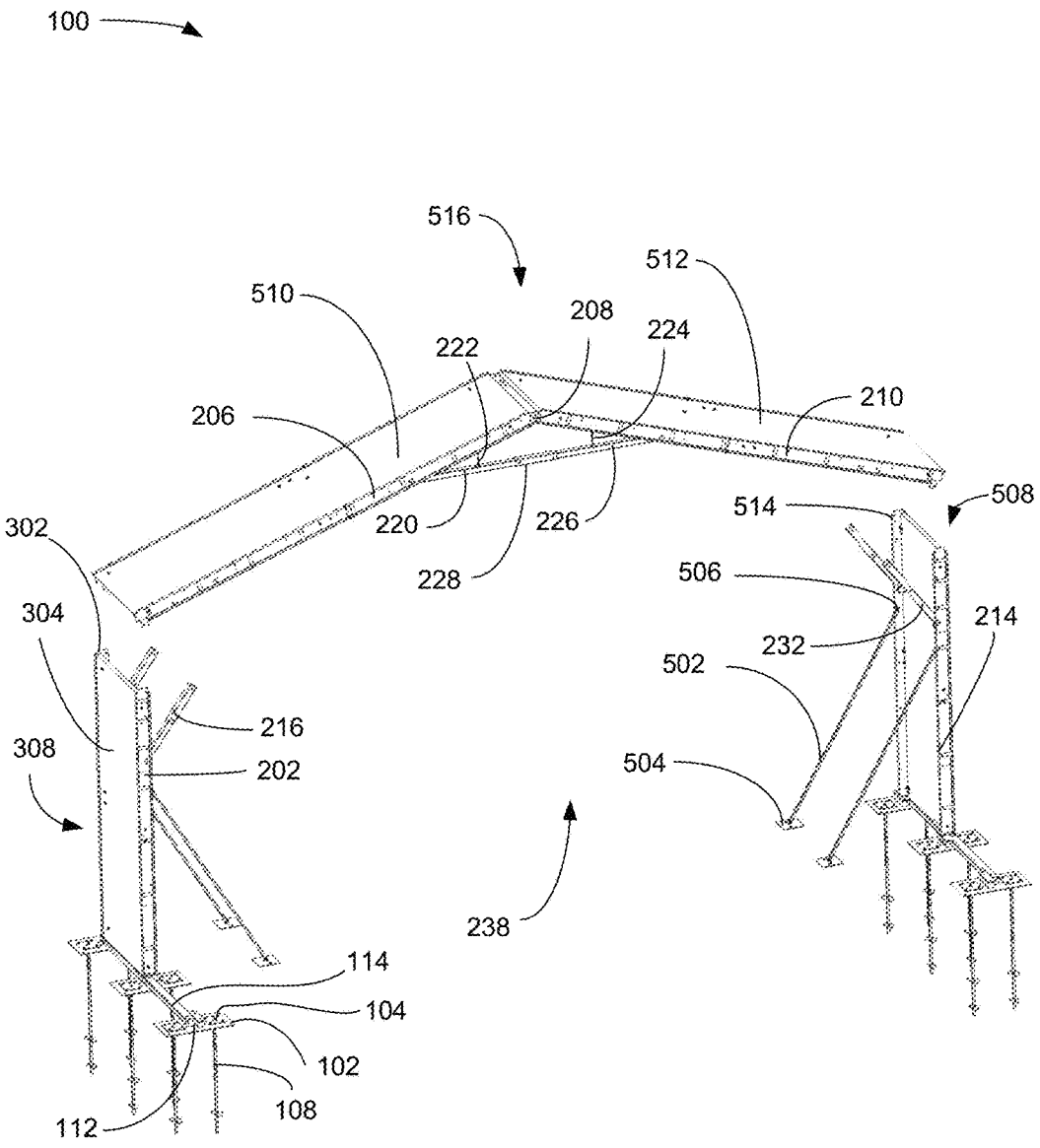
FIG. 5 is a front perspective exploded view illustrating the exemplary embodiment of the rapidly deployable prefabricated folding building of FIG. 2, according to a preferred embodiment of the present invention.

FIG. 5 is a front perspective exploded view illustrating a second exemplary embodiment of the rapidly deployable prefabricated folding building 500, according to a preferred embodiment of the present invention. The subject matter discussed in regard to FIGS. 1, 3, and 4A-4C apply equally to rapidly deployable prefabricated folding building 500. Bearing plates 102 are preferably arranged in parallel spaced apart linear arrays, as shown, for rapidly deployable prefabricated folding buildings 200 and 500. In a particular embodiment, additional parallel spaced apart linear arrays of bearing plates may be used to provide support for "lean to" walls. Exemplary preliminary steps of a preferred second method of construction are illustrated in FIG. 5. First the roof panels 510 and 512 are unfolded and five-hole ridge plates 208 and 606 (see FIG. 6) are fully attached and tightened. Second, the three-part ridge brace 220, 228, 226 is assembled, as is a similar three-part ridge brace 620, 628, 626 for the rafters 602 and 604 (see FIG. 6). Wall panels 308 and 508 are set upon, and attached to, building attachment plates 112 using traditional tilt-up installation and braced with temporary kick braces 502 (one of four labeled). Temporary kick brace 502 extends between an attachment point on column 514 and a footing 504 which is adapted to the substrate in a manner similar to adapting bearing plates 102 and anchors 108. Each wall panel 308 and 508 gets two temporary kick braces 502, one for each column 202, 302, 214, and 514. The roof 516 is then lowered to proximity with the tops of the wall panels 308 and 508 and lower ends of rafters 206 and 210 are attached to columns 202 and 214, respectively, using bolts. Lower ends of rafters 602 and 604 (see FIG. 6) are connected to top ends of columns 302 and 514, respectively, using bolts. Haunch braces 216, 218, 234; 230, 232, 236; and 822, 824, 826 (see FIG. 8), on both sides, are then connected and bolted, completing installation of a section 238.

Figure 6:
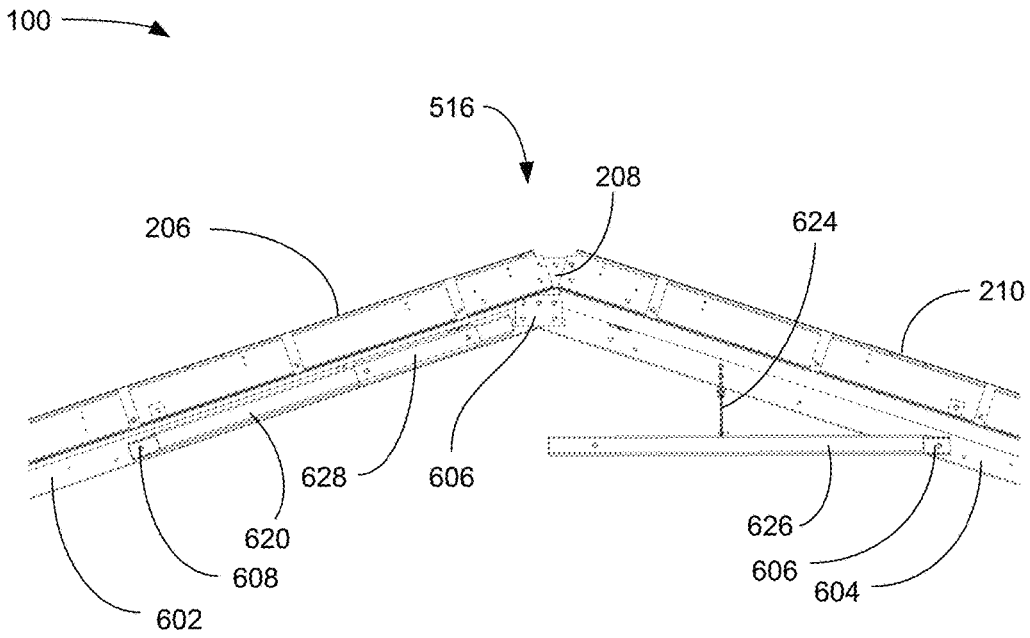
FIG. 6 is a front perspective view illustrating an exemplary detail of the exemplary embodiment of the rapidly deployable prefabricated folding building of FIG. 5, according to a preferred embodiment of the present invention.

FIG. 6 is a front perspective view illustrating an exemplary detail of the exemplary embodiment of the rapidly deployable prefabricated folding building 500 of FIG. 5, according to a preferred embodiment of the present invention. FIG. 6 illustrates details an early step in assembly of the roof 516. Five-hole ridge plates 208 and 606 have been fully attached and tightened. During folded storage and transportation, two of the holes in each five-hole ridge plate 208 and 606 have bolts and three holes are empty. In use, four holes of the five-hole ridge plates 208 and 606 have bolts, and the top center hole is used for lifting and for securing safety lines for roof workers.

Left ridge brace arm 620 and ridge brace coupling sleeve 628 are shown in stowed position. Right ridge brace arm 626 is deployed from stowed position by rotating about pivot 606 and is suspended for coupling alignment by support 624, which is preferably a cable, chain, or similar strong and flexible filament. Support 624 is attached to rafter 604 and to right ridge brace arm 626 and is stowed with right ridge brace arm 626 for transportation and storage.

Figure 7:
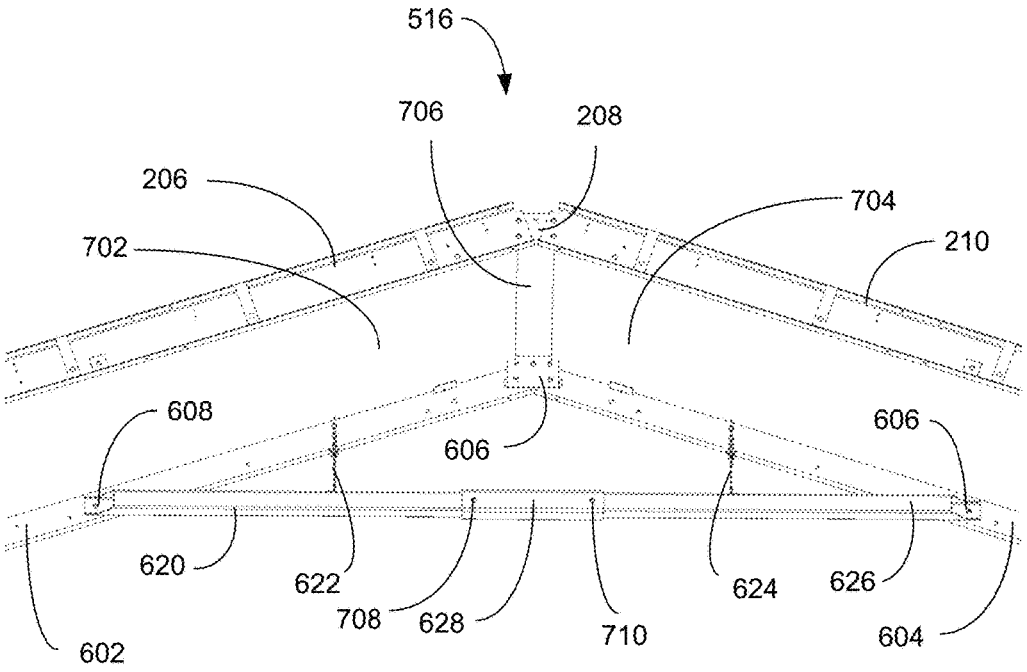
FIG. 7 is a front perspective view illustrating an exemplary detail of the exemplary embodiment of the rapidly deployable prefabricated folding building of FIG. 5, according to a preferred embodiment of the present invention.

FIG. 7 is a front perspective view illustrating an exemplary detail of the exemplary embodiment of the rapidly deployable prefabricated folding building 500 of FIG. 5, according to a preferred embodiment of the present invention. Left ridge brace arm 620 is deployed and is suspended for coupling alignment by support 622, which is preferably a cable, chain, or similar strong and flexible filament. Support 622 is attached to rafter 602 and to left ridge brace arm 620 and is stowed with left ridge brace arm 620 for transportation and storage. As deployed, ridge brace coupling sleeve 628 encloses free ends of left and right ridge brace arms 620 and 626 and is bolted in place through holes 708 and 710 and corresponding holes in left and right ridge brace arms 620 and 626. The bolts used to secure ridge brace coupling sleeves 628 and 228 are preferably color-coded to correspond to colors applied proximate the appropriate bolt holes. The under sides 702 and 704 of roof panels 510 and 512 are visible in this view. Gap 706 between roof panel 510 and 512 will be covered with flashing, as discussed further below.

Figure 8:
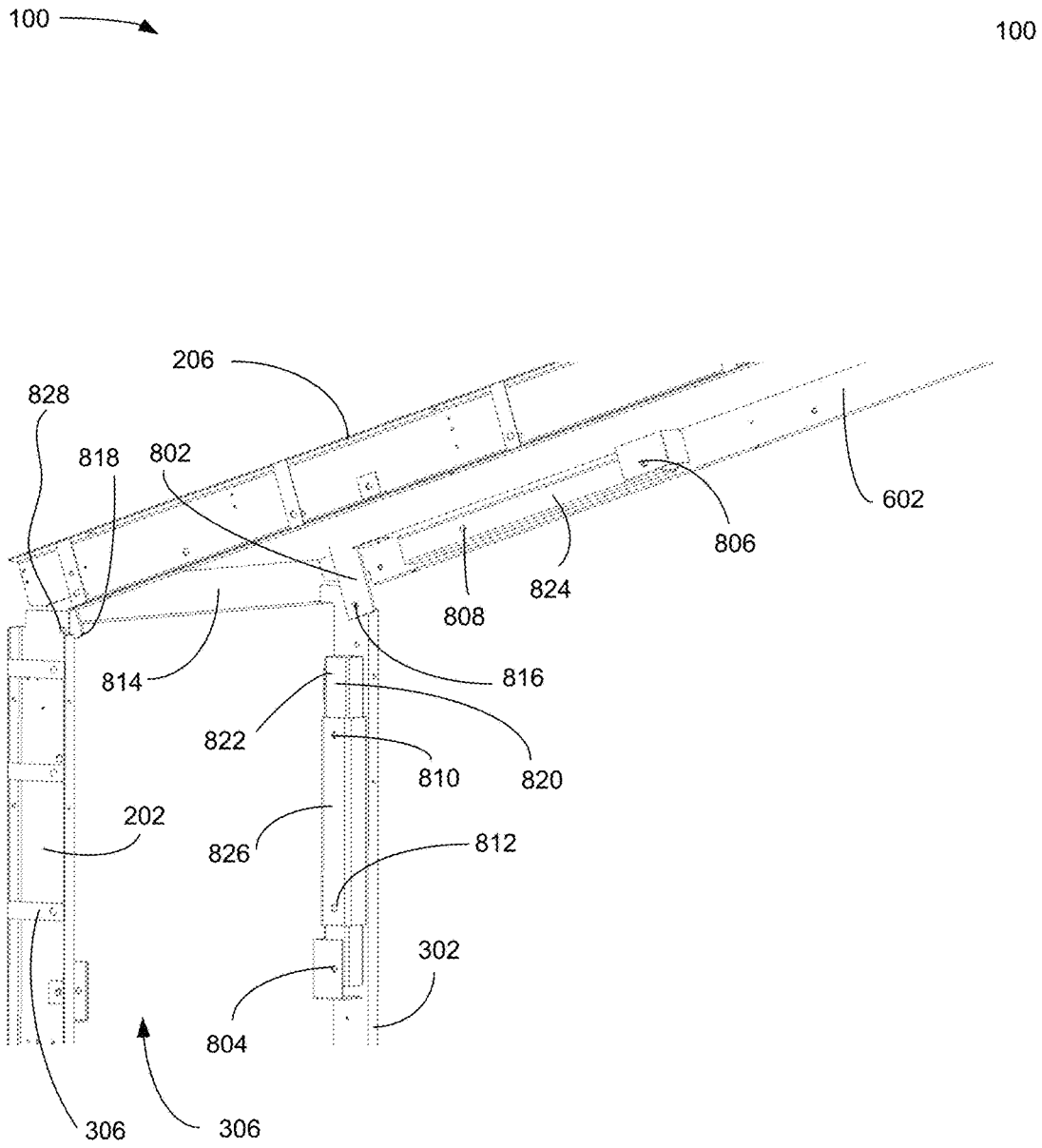
FIG. 8 is a front perspective view illustrating an exemplary detail of the exemplary embodiment of the rapidly deployable prefabricated folding building of FIG. 5, according to a preferred embodiment of the present invention.

FIG. 8 is a front perspective view illustrating an exemplary detail of the exemplary embodiment of the rapidly deployable prefabricated folding building 500 of FIG. 5, according to a preferred embodiment of the present invention. Attachment flange 802 extends from rafter 602 and bolts to the top of column 302 through flange bolt hole 816 and a corresponding pivot bolt hole (similar to pivot bolt hole 828) in the column 302. Attachment flange 818 (barely visible) is similarly configured to column 202 and pivot bolt hole 828. Haunch brace column arm 216 is shown in a stowed configuration with haunch brace coupling sleeve 228. Haunch brace column arm 216 is secured at a first end by pivot 804 and at the opposing end by another means, which may be a bolt through bolt hole 820 and a corresponding hole (not visible in this view) in column 302, a bundle tie, twine, clamp, or similar restraints. Haunch brace coupling sleeve 228 has bolt holes 810 and 812 for securing free ends of haunch brace column arm 822 and haunch brace rafter arm 824. Haunch brace rafter arm 824 is secured at a first end by pivot 806 and at a distal end by another means, which may be a bolt through bolt hole 808 and a corresponding hole (not visible) in rafter 602, a bundle tie, twine, clamp, or similar restraints. Crossbar 814 tops wall panel 308. The bolts used to make a pivotal connection between the rafters 206 and 602 and between the columns 202 and 302, respectively, are preferably color-coded to correspond to colors applied proximate the appropriate bolt holes. Once the feet 312 of the wall panels 308 and 508 (see FIGS. 3 and 5) are secured to the building attachment plates 112, the pivot bolts are tightened to prevent further pivoting.

Figure 9:
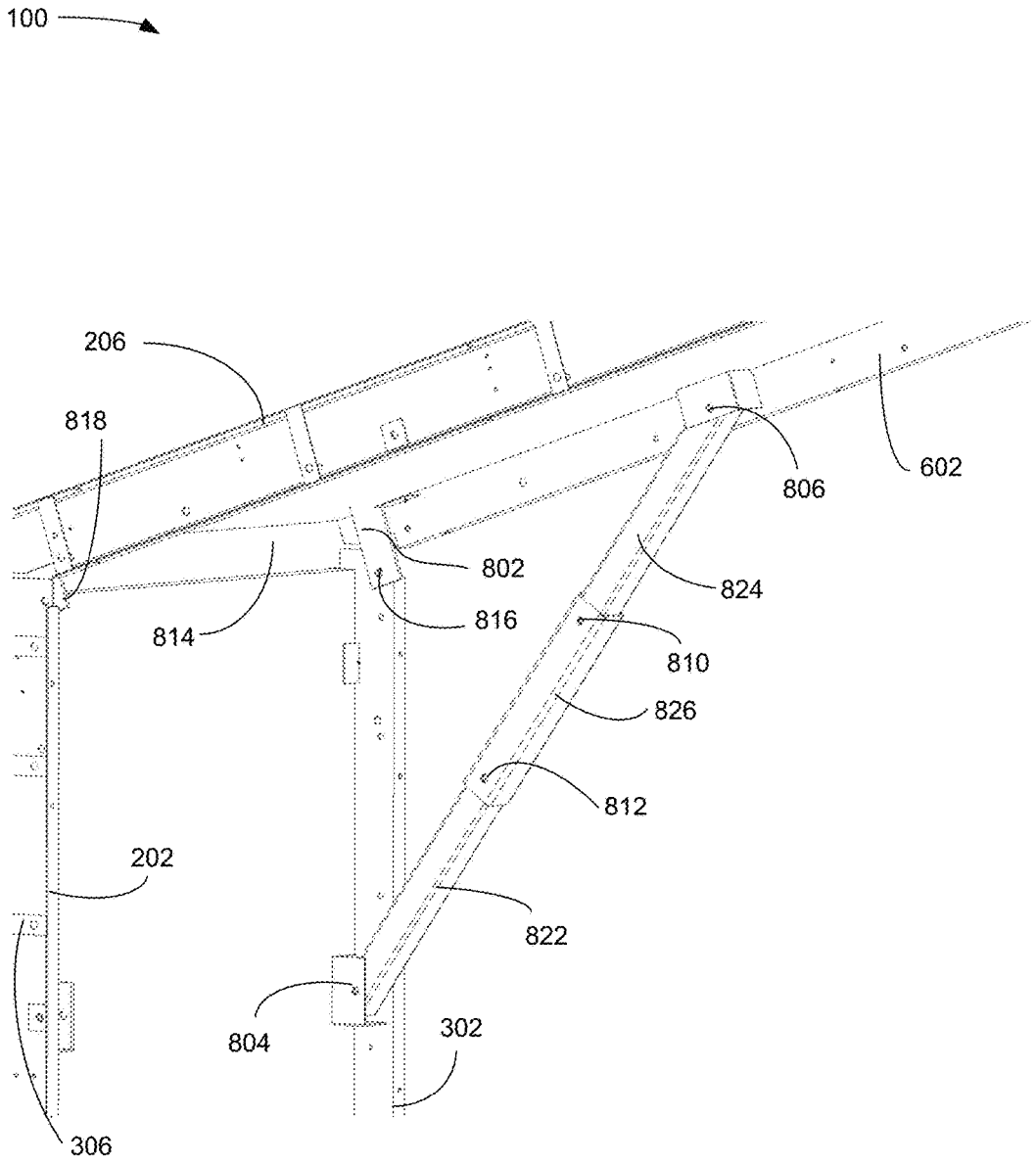
FIG. 9 is a front perspective view illustrating an exemplary detail of the exemplary embodiment of the rapidly deployable prefabricated folding building of FIG. 5, according to a preferred embodiment of the present invention.

FIG. 9 is a front perspective view illustrating an exemplary detail of the exemplary embodiment of the rapidly deployable prefabricated folding building 500 of FIG. 5, according to a preferred embodiment of the present invention. Three-part haunch brace 822, 824, 826 is shown deployed and secured. Haunch brace column arm 822 has rotated about pivot 804 to align with haunch brace rafter arm 824 which has rotated about pivot 806. Haunch brace coupling sleeve 826 has been translated to enclose ends of haunch brace column arm 822 and haunch brace rafter arm 824 and has been secured by bolts through bolt holes 812 and 810 and a corresponding bolt hole in haunch brace column arm 822 (obscured by haunch brace coupling sleeve 826) and bolt hole 808 in haunch brace rafter arm 824, respectively.

Figure 10:
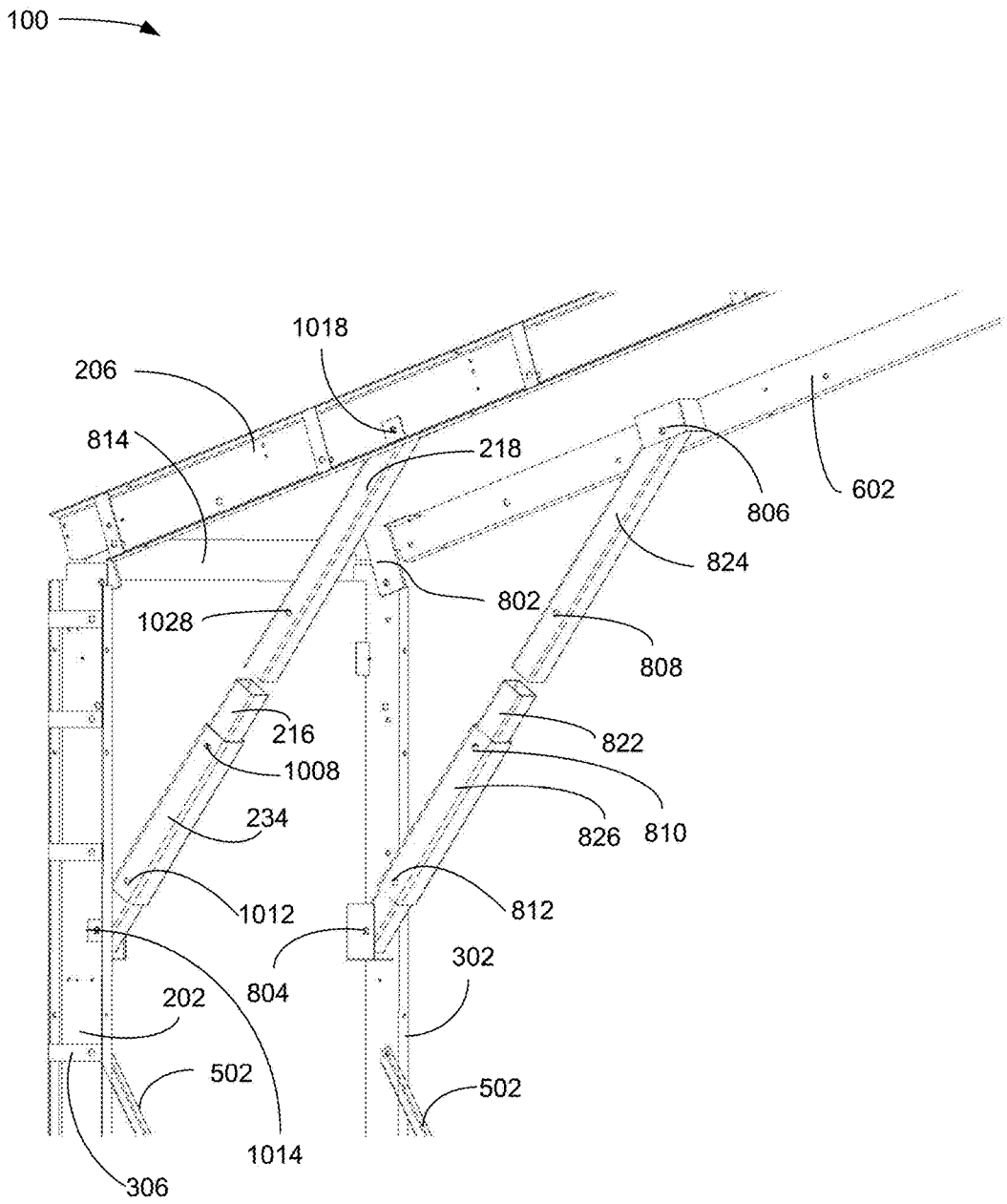
FIG. 10 is a front perspective view illustrating an exemplary detail of the exemplary embodiment of the rapidly deployable prefabricated folding building of FIG. 5, according to a preferred embodiment of the present invention.

FIG. 10 is a front perspective view illustrating an exemplary detail of the exemplary embodiment of the rapidly deployable prefabricated folding building 500 of FIG. 5, according to a preferred embodiment of the present invention. Three-part haunch brace 216, 228, 226 is shown just before haunch brace coupling sleeve 228 is moved into assembled position. Second three-part haunch brace 822, 824, 826 is shown in a similar position. Second haunch brace column arm 822 has rotated about pivot 804 (seen from the rear side) into alignment with second haunch rafter arm 824, which has rotated into coupling alignment about pivot 1018. Second haunch brace coupling sleeve 234 has bolt hole 1008 for alignment to bolt hole 1028 in second haunch brace rafter arm 1026 and bolt hole 1012 for alignment to a bolt hole in second haunch brace column arm, which hole is not visible in this view. The bolts used to secure haunch brace coupling sleeves 234 and 826 are preferably color-coded to correspond to colors applied proximate the appropriate bolt holes.

Figure 11:
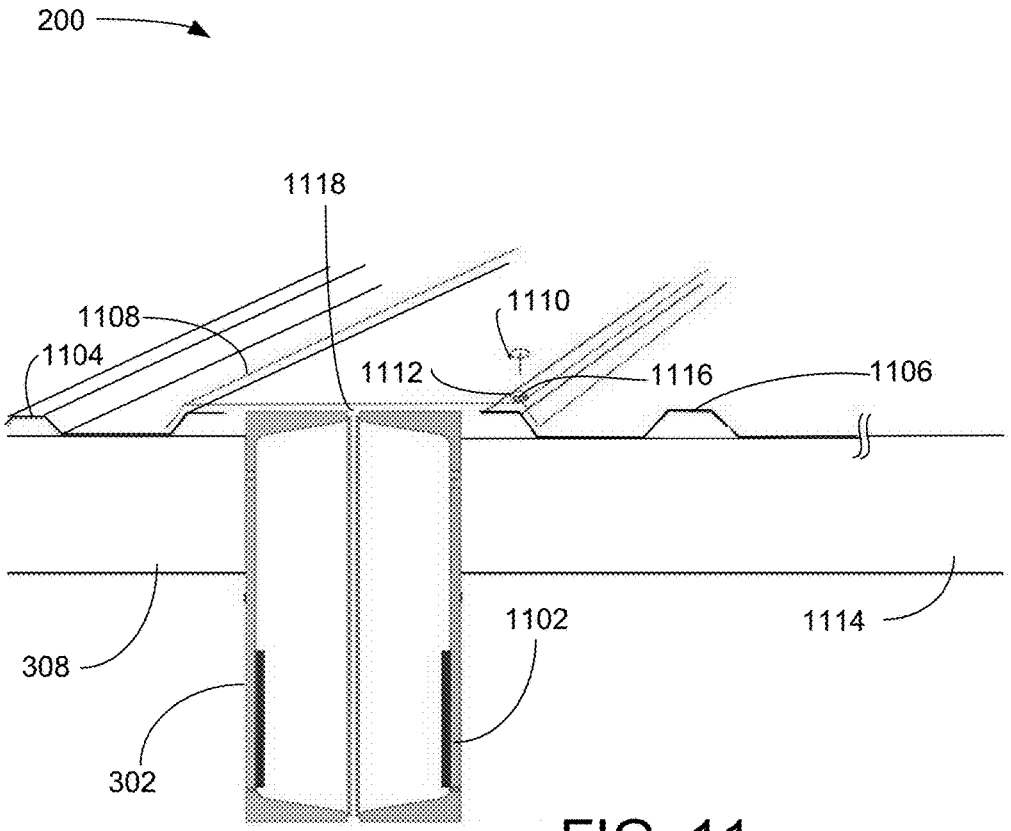
FIG. 11 is a front elevation view illustrating an exemplary detail of the exemplary embodiment of the rapidly deployable prefabricated folding building of FIG. 5, according to a preferred embodiment of the present invention.

FIG. 11 is a front perspective diagrammatic view illustrating an exemplary detail of the exemplary embodiment of the rapidly deployable prefabricated folding building 200 of FIG. 2, according to a preferred embodiment of the present invention. An advantage of the present invention is that the factory prepared insulated flashing 1108 has pre-drilled screw holes 1112 (one of many illustrated) that align with threaded rivets 1116 (one of many illustrated) in holes 1206 (see FIG. 12) in the corrugated metal siding panels 1104 and 1106 to receive screws 1110 (one of many illustrated). The flashing 1108 is shown covering an exterior seam 1118 between two columns 302 and 1102 of adjacent wall panels 308 and 1114, respectively. Similar flashing 1108 is used for rafter seams and ridge covering. The screws used to secure flashing 1108 are preferably color-coded to correspond to colors applied proximate the appropriate screw holes 1112. All flashing 1108 is factory cut to the correct length. Insulation (not shown), preferably closed-cell foam insulation, is adhered to the inside of the flashing 1108. Another advantage of the present invention is that the flashing 1108 is reusable. The entire rapidly deployable prefabricated folding building 200 can be non-destructively disassembled, transported, and reassembled at a new location.

Figure 12:
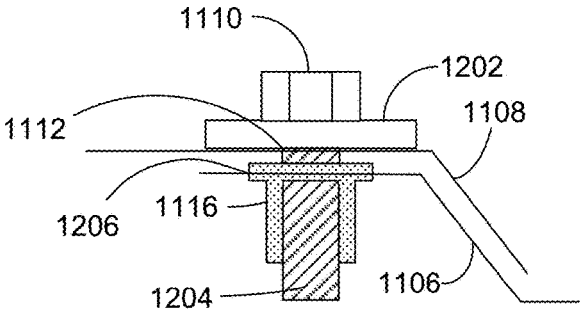
FIG. 12 is a front perspective view illustrating an exemplary detail of the exemplary embodiment of the rapidly deployable prefabricated folding building of FIG. 5, according to a preferred embodiment of the present invention.

FIG. 12 is a front elevation view illustrating an exemplary detail of the exemplary embodiment of the rapidly deployable prefabricated folding building 500 of FIG. 5, according to a preferred embodiment of the present invention. FIG. 12 illustrates a detail of FIG. 11. Threaded portion 1204 of screw 1110 extends through gasket washer 1202, then through a pre-drilled color-coded hole 1112 in flashing 1108, then into threaded rivet 1116 factory installed in a pre-drilled hole 1206 in corrugated siding 1106.

Figure 13:
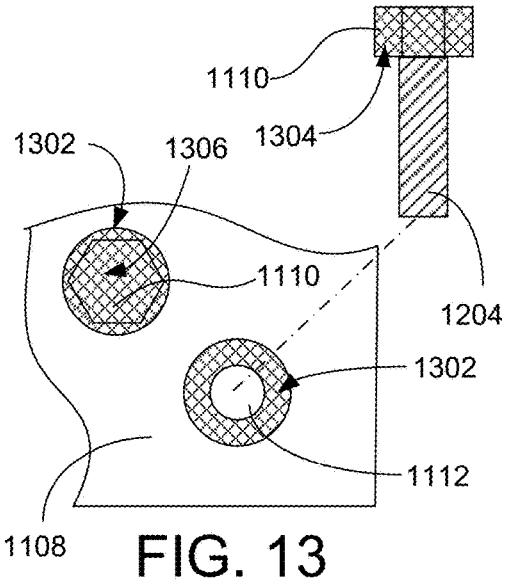
FIG. 13 is a diagrammatic view illustrating an exemplary embodiment of a fastener color coding scheme in the exemplary embodiment of the rapidly deployable prefabricated folding building of FIG. 5, according to a preferred embodiment of the present invention.

FIG. 13 is a diagrammatic view illustrating an exemplary embodiment of a fastener color coding scheme in the exemplary embodiment of the rapidly deployable prefabricated folding building 500 of FIG. 5, according to a preferred embodiment of the present invention. Flashing 1108 has a screw hole 1112 surrounded by an annular area of applied surface colorant 1302, such as, without limitation, paint, ink, or stain, as indicated by cross hatching. Screw 1110 has surface colorant 1304, which is the same color as colorant 1302, applied to the sides of the screw head, as indicated by cross hatching. Screw 1110 has surface colorant 1306, which is the same color as colorant 1302, applied to the top of the screw head, as indicated by cross hatching. It is preferred to make the extent of the applied surface colorant 1302 greater than the extent of the screw head 1110 in order to make quality control inspection easy. In various embodiments, various patterns for applying colorants 1302, 1304, and 1306 may be employed. For non-limiting example, applying the colorants 1302, 1304, and 1306 not as a complete covering, but in small patches of corresponding shapes for the benefit of the colorblind, may be appropriate in some embodiments.

There only difference between rapidly deployable prefabricated folding building 500 and rapidly deployable prefabricated folding building 200 is the construction sequence: the end product is the same. FIG. 2 shows that the novel footing system 100 works with the existing construction method, while FIG. 5 shows that the novel footing system 100 works with the new rapid construction method, as well.

I claim:

1. A rapidly deployable prefabricated folding building comprising:

a. a steel bearing plate;

b. a T-shaped building attachment plate:

i. supported above, and vertically spaced apart from, a top surface of said steel bearing plate by a plurality of vertical support plates; and ii. having a horizontal stem and crossbar; and c. first and second anchor adapter plates releasably attached to said top surface of said steel bearing plate on opposed sides of said T-shaped building attachment plate.

2. The building of claim 1, comprising first and second building attachment plate connecting beam bolt holes in first and second support plates of said plurality of support plates spaced apart extending downward from respective first and second sides of said stem to said bearing plate.

3. The building of claim 2, comprising a connecting beam further comprising:

a. an elongated steel I-beam with first and second ends;

b. first and second end plates fixed to respective said first and second ends of said elongated steel I-beam and closing off said first and second ends of said elongated steel I-beam on both sides of a web of said I-beam; and c. first and second vertical slots centered on each said connecting beam end plate side alignable to respective said first and second connecting beam bolt holes.

4. The building of claim 3, comprising:

a. an aligned, spaced apart, linear array of a plurality of said steel bearing plates, wherein said array includes at least two spaced apart rows;

b. a plurality of connecting beams extending between each two neighboring said building attachment plates in each row of said aligned, spaced apart, linear array of a plurality of said steel bearing plates; and c. wherein each said connecting beam of said plurality of said connecting beams is releasably attached via first and second bolts through said first and second slots and through said first and second supporting plate connecting beam bolt holes, respectively, of first and second said neighboring building attachment plates, respectively.

5. The building of claim 4, wherein each said connecting beam in one said row is aligned to a common level over a substrate that is not level.

6. The building of claim 1, comprising first and second anchors releasably and directly attached to said first and second anchor adapter plates, respectively, and operable to extend into a substrate to secure said steel bearing plate to said substrate.

7. The building of claim 4, comprising a plurality of prefabricated wall panels each having:

a. first and second spaced-apart opposed C-channel columns; and b. at least one wall material extending between said first and second columns;

c. first and second releasably stowable haunch brace column arms having respective first and second first ends pivotally secured to said first and second columns, respectively;

d. first and second releasably stowable haunch brace coupling sleeves enclosing respective said first and second haunch brace column arms;

e. a first pivot bolt hole proximate a top end of each said column; and f. first and second footings, each adapted to attach to one of:

i. said building attachment plate; and ii. a shim attached to said building attachment plate.

8. The building of claim 7, comprising first and second temporary kick braces connectable to said first and second columns, respectively, and to respective first and second support footings.

9. The building of claim 7, comprising a plurality of said first and second prefabricated roof panel pairs, each prefabricated roof panel in each said roof panel pair having:

a. first and second spaced-apart parallel opposed C-channel rafters; and b. at least one roof material extending between said first and second rafters;

c. first and second releasably stowable haunch brace rafter arms, proximate the lower end of said roof panel, having respective first and second first ends pivotally secured to said first and second said rafters, respectively;

d. first and second releasably stowable ridge brace rafter arms, proximate the upper end of each said roof panel, having respective first and second first ends pivotally secured to said first and second rafters, respectively;

e. wherein first and second said ridge brace rafter arms are supported during deployment by first and second releasably stowable support filaments connected between respective said first and second rafters and respective said first and second ridge brace rafter arms;

f. a pivot bolt flange, having a second pivot bolt hole, extending proximate a lower end of each said rafter; and g. said first and second rafters each comprise an adaption to attach to a five-hole ridge plate.

10. The building of claim 9, comprising:

a. first and second releasably stowable haunch brace coupling sleeves enclosing respective said first and second ridge brace rafter arms of one of said first and second roof panels of one said pair of roof panels of said plurality of roof panel pairs;

b. a corrugated metal exterior panel on each said wall panel and each said roof panel and further comprising first and second linear arrays of screw holes proximate first and second side edges, respectively, of said corrugated metal exterior panel;

c. a first plurality of seams between adjacent said columns and adjacent said rafters, when said rapidly deployable prefabricated folding building has a plurality of said sections installed in adjacent linear side-by-side array;

d. said first plurality of flashing sections having a second plurality of predetermined lengths; and e. predrilled screw holes in each said flashing section of said first plurality of flashing sections, in first and second linear arrays of said screw holes proximate first and second side edges of said flashing section, respectively, and corresponding to said first and second linear arrays of screw holes proximate said first and second side edges, respectively, of said corrugated metal exterior panels.

11. The building of claim 10, comprising color-coded said bolts and said screws corresponding to color-coded said bolt holes and said screw holes, respectively.

12. A rapidly deployable prefabricated folding building comprising:

a. a steel bearing plate;

b. a T-shaped building attachment plate:

i. supported above, and vertically spaced apart from, a top surface of said steel bearing plate via a plurality of vertical support plates; and ii. having a horizontal stem and crossbar;

c. first and second anchor adapter plates releasably attached to said top surface of steel bearing plate on opposed sides of said T-shaped building attachment plate; and d. first and second building attachment plates having first and second connecting beam bolt holes in first and second support plates, wherein said first and second support plates extend downward from respective opposed spaced apart sides of said stem to said bearing plate.

13. The building of claim 12, comprising a connecting beam further comprising:

a. an elongated steel I-beam with first and second ends;

b. first and second end plates fixed to said first and second ends of said elongated steel I-beam and closing off said first and second ends of said elongated steel I-beam on both sides of a web of said I-beam;

c. first and second vertical slots in each said connecting beam end plate side alignable to said first and second connecting beam bolt holes.

14. The building of claim 13, comprising:

a. an aligned, spaced apart, linear array of a plurality of said steel bearing plates, wherein said array includes at least two spaced apart rows;

b. a plurality of connecting beams extending between each two neighboring said building attachment plates in each said row of said aligned, spaced apart, linear array of a plurality of said steel bearing plates;

c. wherein each said connecting beam of said plurality of said connecting beams is releasably attached via first and second bolts through said first and second slots and through said first and second supporting plate connecting beam bolt holes, respectively, of first and second said neighboring building attachment plates, respectively;

d. first and second anchors releasably attachable to said first and second anchor adapter plates, respectively, and operable to extend into a substrate to secure said steel bearing plate to said substrate.

15. The building of claim 14, wherein each said connecting beam in one said row is alignable to a common level over a substrate that is not level.

16. The building of claim 14, comprising:

a. a plurality of prefabricated wall panels each having:

i. first and second spaced-apart opposed parallel C-channel columns; and ii. at least one wall material extending between said first and second columns;

iii. first and second releasably stowable haunch brace column arms having respective first and second first ends pivotally secured to said first and second columns, respectively;

iv. first and second releasably stowable haunch brace coupling sleeves enclosing respective said first and second haunch brace column arms;

v. a first pivot bolt hole proximate a top end of each said column;

vi. an adaption to attach to one of:

1. said building attachment plate; and 2. a shim attached to said building attachment plate; and vii. first and second temporary kick braces connectable to said first and second columns, respectively, and connectable to first and second support footings, respectively;

b. a plurality of said first and second prefabricated roof panel pairs, each prefabricated roof panel having:

i. first and second spaced-apart parallel opposed C-channel rafters;

ii. at least one roof material extending between said first and second rafters;

iii. first and second releasably stowable haunch brace rafter arms, proximate the lower end of said roof panel, having respective first and second first ends pivotally secured to said first and second said rafters, respectively;

iv. first and second releasably stowable ridge brace rafter arms, proximate the upper end of each said roof panel, having respective first and second first ends pivotally secured to said first and second rafters, respectively;

v. wherein first and second said ridge brace rafter arms are supported during deployment by first and second releasably stowable support filaments connected between respective said first and second rafters and respective said first and second ridge brace rafter arms;

vi. a pivot bolt flange, having a second pivot bolt hole, extending proximate a lower end of each said rafter; and vii. an adaption to assist in attachment to a five-hole ridge plate to said first and second rafters.

17. The building of claim 16, comprising:

a. first and second releasably stowable haunch brace coupling sleeves enclosing respective first and second said first ridge brace rafter arms on one said roof panel of one said pair of roof panels;

b. corrugated metal exterior panels attached to each said wall panel and each said roof panel and further comprising first and second linear arrays of bolt holes proximate first and second side edges, respectively, of said corrugated metal exterior panels;

c. a first plurality of seams between adjacent said columns and adjacent said rafters, when said rapidly deployable prefabricated folding building has a plurality of said sections installed in adjacent linear array;

d. said first plurality of flashing sections having a second plurality of predetermined lengths; and e. said first plurality of flashing sections having predrilled screw holes in each said flashing section arranged as first and second linear arrays of screw holes proximate first and second side edges of each said flashing section, respectively, and corresponding to said first and second linear arrays of screw holes proximate said first and second side edges, respectively, of said corrugated metal exterior panels.

18. The building of claim 17, comprising color-coded said bolts and said screws corresponding to color-coded said bolt holes and said screw holes.

19. A rapidly deployable prefabricated folding building comprising:

a. a steel bearing plate;

b. a T-shaped building attachment plate:

i. supported above a top surface of said steel bearing plate via a plurality of vertical support plates; and ii. having a horizontal stem and crossbar;

c. first and second anchor adapter plates releasably attached to said top surface of steel bearing plate over first and second openings in said bearing plate on opposed sides of said T-shaped building attachment plate;

d. first and second building attachment plate connecting beam bolt holes in first and second support plates of said plurality of support plates extending from respective first and second sides of said stem to said bearing plate;

e. a connecting beam further comprising:

i. an elongated steel I-beam with first and second ends;

ii. first and second end plates fixed to said first and second ends of said elongated steel I-beam and closing off said first and second ends of said elongated steel I-beam on both sides of a web of said I-beam;

iii. first and second vertical slots in each said connecting beam end plate side alignable to said first and second connecting beam bolt holes;

f. an aligned, spaced apart, linear array of a plurality of said steel bearing plates, wherein said array includes at least two spaced apart rows;

g. a plurality of connecting beams extending between each two neighboring said building attachment plates in each said row of said aligned, spaced apart, linear array of said plurality of steel bearing plates;

h. wherein said first and second ends of each said connecting beam of said plurality of said connecting beams is releasably attached via first and second bolts through said first and second slots in said first and second end plates and through said first and second building support plate connecting beam bolt holes, respectively, of first and second said neighboring building attachment plates, respectively;

i. first and second anchors releasably attachable to said first and second anchor adapter plates, respectively, and operable to extend into a substrate to secure said steel bearing plate to said substrate j. wherein each said connecting beam in one said row is alignable to a common level over a substrate that is not level;

k. a plurality of prefabricated wall panels each having:

i. first and second spaced-apart opposed C-channel columns; and ii. at least one wall material extending between said first and second columns;

iii. first and second releasably stowable haunch brace column arms having respective first and second first ends pivotally secured to said first and second columns, respectively;

iv. first and second releasably stowable haunch brace coupling sleeves enclosing said first and second haunch brace column arms, respectively;

v. a first pivot bolt hole proximate a top end of each said column; and vi. an adaption to attach to one of:

1. said building attachment plate; and 2. a shim attached to said building attachment plate;

vii. first and second temporary kick braces connectable to said first and second columns, respectively, and to a support footing; and 1. a plurality of said first and second prefabricated roof panel pairs, each prefabricated roof panel having:
   i. first and second spaced-apart parallel opposed C-channel rafters;
   ii. at least one roof material extending between said first and second rafters;
   iii. first and second releasably stowable haunch brace rafter arms, proximate the lower end of said roof panel, having respective first and second first ends pivotally secured to said first and second said rafters, respectively;
   iv. first and second releasably stowable ridge brace rafter arms, proximate the upper end of each said roof panel, having respective first and second first ends pivotally secured to said first and second rafters, respectively;
   v. wherein first and second said ridge brace rafter arms are supported during deployment by first and second releasably stowable support filaments connected between respective said first and second rafters and respective said first and second ridge brace rafter arms;
   vi. a pivot bolt flange, having a second pivot bolt hole, extending proximate a lower end of each said rafter; and
   vii. an adaption to attach said first and second rafters to a five-hole ridge plate.

20. The building of claim 19, comprising:

a. first and second releasably stowable haunch brace coupling sleeves enclosing respective first and second said ridge brace rafter arms on one said roof panel of each said roof panel pair;

b. corrugated metal exterior panels on each said wall panel and each said roof panel further comprising first and second linear arrays of bolt holes proximate first and second side edges, respectively, of said corrugated metal exterior panels;

c. a first plurality of seams between adjacent said columns and adjacent said rafters, when said rapidly deployable prefabricated folding building has a plurality of said sections installed in adjacent linear array;

d. said first plurality of flashing sections having a second plurality of predetermined lengths;

e. said first plurality of flashing sections having predrilled screw holes in each said flashing section arranged as first and second linear arrays of screw holes proximate first and second side edges of each said flashing section, respectively, and corresponding to said first and second linear arrays of screw holes proximate said first and second side edges, respectively, of said corrugated metal exterior panels; and f. color-coded said bolts and said screws corresponding to color-coded said bolt holes and said screw holes, respectively.

* * * * *